US010189139B2

(12) United States Patent
Gacoin et al.

(10) Patent No.: US 10,189,139 B2
(45) Date of Patent: Jan. 29, 2019

(54) SURFACING TOOL FOR OPTICAL PURPOSES

(71) Applicant: ESSILOR INTERNATIONAL (COMPAGNIE GENERALE D'OPTIQUE), Charenton-le-Pont (FR)

(72) Inventors: Eric Gacoin, Charenton-le-Pont (FR); Jonathan Saulny, Charenton-le-Pont (FR); Jean Stephane, Charenton-le-Pont (FR)

(73) Assignee: ESSILOR INTERNATIONAL, Charenton-le-Pont (FR)

( * ) Notice: Subject to any disclaimer, the term of this patent is extended or adjusted under 35 U.S.C. 154(b) by 172 days.

(21) Appl. No.: 15/031,033

(22) PCT Filed: Oct. 24, 2014

(86) PCT No.: PCT/EP2014/072906

§ 371 (c)(1),
(2) Date: Apr. 21, 2016

(87) PCT Pub. No.: WO2015/059299

PCT Pub. Date: Apr. 30, 2015

(65) Prior Publication Data

US 2016/0288287 A1 Oct. 6, 2016

(30) Foreign Application Priority Data

Oct. 25, 2013 (EP) ..... 13306477

(51) Int. Cl.
*B24B 13/02* (2006.01)
*B24D 9/08* (2006.01)

(52) U.S. Cl.
CPC ..... *B24B 13/02* (2013.01); *B24D 9/08* (2013.01)

(58) Field of Classification Search
CPC ..... B24B 13/02; B24D 9/08
(Continued)

(56) References Cited

U.S. PATENT DOCUMENTS 2,189,472 A * 2/1940 Peterson ..... B24D 9/08 15/230
5,944,586 A * 8/1999 Sevigny ..... B24D 7/04 451/359

(Continued)

FOREIGN PATENT DOCUMENTS

EP 1 327 496 A2 7/2003
EP 2 199 016 A2 6/2010

(Continued)

OTHER PUBLICATIONS

International Search Report, dated Nov. 17, 2014, from corresponding PCT application.

*Primary Examiner* — George Nguyen
(74) *Attorney, Agent, or Firm* — Young & Thompson

(57) ABSTRACT

A surfacing tool for optical purposes, includes a body (30) for mounting the tool (10) on a surfacing machine, an elastically compressible interface (12), a flexible buff (13), and a connecting structure between the mounting body (30) and the elastically compressible interface (12). The connecting structure includes a bell (11), and a supporting body (14) between the peripheral wall (17) of the bell (11) and the periphery of the interface (12), the body (30) for mounting the tool (10) on a surfacing machine (32, 33) being connected to the main body (16) on the side opposite the side facing the interface.

19 Claims, 11 Drawing Sheets

(58) Field of Classification Search
USPC ..... 451/490
See application file for complete search history.

(56) References Cited

U.S. PATENT DOCUMENTS

| | | | | |
|---|---|---|---|---|
| 6,443,825 | B2 * | 9/2002 | Schadoffsky | B24D 9/00 451/344 |
| 8,475,237 | B2 * | 7/2013 | Meynen | B24B 13/02 451/520 |
| 8,574,035 | B2 | 11/2013 | Schneider et al. | |
| 8,668,557 | B2 * | 3/2014 | Batard | B24B 13/02 451/512 |
| 2005/0101235 | A1 | 5/2005 | Huguet | |
| 2005/0186887 | A1 | 8/2005 | Nomura et al. | |
| 2006/0073770 | A1 | 4/2006 | Toyoshima et al. | |
| 2006/0154581 | A1 | 7/2006 | Bernard et al. | |
| 2010/0178858 | A1 | 7/2010 | Stephane | |
| 2011/0136416 | A1 | 6/2011 | Meynen | |
| 2012/0071073 | A1 * | 3/2012 | Farber | B24B 23/02 451/490 |
| 2012/0231713 | A1 | 9/2012 | Batard et al. | |

FOREIGN PATENT DOCUMENTS

| | | | |
|---|---|---|---|
| FR | 2 918 911 | A1 | 1/2003 |
| FR | 2 834 662 | A1 | 7/2003 |
| FR | 2 857 610 | A1 | 1/2005 |
| FR | 2 935 627 | A1 | 3/2010 |
| FR | 2 953 433 | A1 | 6/2011 |
| JP | 2002172550 | | 6/2002 |
| JP | 2000-317797 | A | 1/2009 |

* cited by examiner

SURFACING TOOL FOR OPTICAL PURPOSES

FIELD OF THE INVENTION

The invention relates to optical-quality surfacing for surfaces such as a face of an ophthalmic lens or of a lens for photographic equipment or for an instrument intended to view distant objects or even a face of a semiconductor substrate.

Surfacing means any operation aimed at modifying the finish of an already-shaped surface. It notably involves polishing, surface-grinding or matting operations aimed at modifying (reducing or increasing) the surface roughness and/or at reducing waviness.

BACKGROUND

A tool for surfacing an optical surface and comprising: a rigid support having a transverse end surface; an elastically compressible interface secured to the rigid support and having a first transverse end surface, a second transverse end surface and a lateral surface extending from the periphery of the first end surface to the periphery of the second end surface, said first end surface of the interface being pressed against and covering said end surface of the rigid support; and a flexible pad that can be pressed against the optical surface and which is pressed against and at least in part covers the second end surface of the interface opposite to and in line with said end surface of the rigid support is already known, notably from Japanese Patent Application 2000-317797, from French Patent Application 2 834 662 to which American Patent Application 2005/0101235 corresponds, from French Patent Application 2 857 610 to which American Patent Application 2006/0154581 corresponds, from French Patent Application 2 918 911 to which American Patent Application 2010/0178858 corresponds, from French Patent Application 2 935 627 to which American Patent Application 2011/0136416 corresponds, from French Patent Application 2 935 628 to which American Patent Application 2011/0136415 corresponds and from French Patent Application 2 953 433 to which American Patent Application 2012/0231713 corresponds.

In order to reduce the roughness of the optical surface, the tool is brought into contact therewith while maintaining sufficient tool pressure on this surface that, through deformation of the interface, the pad adopts the shape of the optical surface.

Whilst spraying the optical surface with a fluid, it is driven in relative motion with respect to the tool so that it is completely swept by the latter.

In general, the optical surface is rotationally driven and its friction against the tool is enough to drive the latter in rotation also, an eccentricity that can be varied during the course of the operation ensuring the relative movement and sweep.

The surfacing operation requires an abrasive which may be contained in the pad or in the fluid.

During the surfacing, the elastically compressible interface makes it possible to compensate for the difference in curvature between the end surface of the support of the tool and the optical surface.

SUBJECT OF THE INVENTION

The invention seeks to provide a surfacing tool which performs particularly well in terms of minimizing appearance defects.

To that end it proposes an optical-quality surfacing tool comprising:

- an elastically compressible interface comprising a first transverse end surface, a second transverse end surface and a lateral surface extending from the periphery of the first transverse end surface to the periphery of the second transverse end surface;
- a flexible pad configured to be pressed against a workpiece surface, and secured to the interface by its second transverse end surface; and
- a connecting structure connecting said elastically compressible interface and a member for mounting the tool on a surfacing machine;

characterized in that said connecting structure is configured to form a bearing surface resting against part of the lateral surface and/or of the first transverse end surface of the interface, leaving at least part of the lateral surface and at least a central part of the first transverse end surface of the interface free.

With a connecting structure configured in this way the flexible pad can be guaranteed to conform well to the workpiece surface whatever this may be, so as to allow high-quality surfacing.

According to advantageous features of the configuration of the connecting structure, the latter comprises a bell housing comprising a main body and a peripheral wall projecting from the periphery of said body and extending as far as a free end; and said connecting structure comprises a bearing member between the peripheral wall of the bell housing and the periphery of the interface; said peripheral wall of the bell housing being pressed against a part of the lateral surface and/or of the first transverse surface of the interface; at least an annular portion of the lateral surface of the interface being free; said first transverse end surface of the interface being on the side of and distant from the main body.

In other words, with these advantageous features, the invention proposes an optical-quality surfacing tool comprising:

- an elastically compressible interface comprising a first transverse end surface, a second transverse end surface and a lateral surface extending from the periphery of the first transverse end surface to the periphery of the second transverse end surface;
- a flexible pad configured to be pressed against a workpiece surface, and secured to the interface by its second transverse end surface; and
- a connecting structure connecting said elastically compressible interface and a member for mounting the tool on a surfacing machine;

characterized in that said connecting structure comprises a bell housing comprising a main body and a peripheral wall projecting from the periphery of said body and extending as far as a free end; and said connecting structure comprises a bearing member between the peripheral wall of the bell housing and the periphery of the interface; said peripheral wall of the bell housing being pressed against a part of the lateral surface and/or of the first transverse surface of the interface; at least an annular portion of the lateral surface of the interface being free; said first transverse end surface of the interface being on the side of and distant from the main body.

Given that the interface is elastically compressible and that the bell housing and this elastically compressible interface bear against one another via the periphery of the elastically compressible interface, the flexible pad can be guaranteed to conform well to the workpiece surface whatever this may be, so as to allow particularly high-quality surfacing.

It will be noted that the tool according to the invention remains simple, convenient and economical to manufacture and to use.

According to preferred features:

- the tool further comprises an elastic return member positioned between the bell housing and the first transverse end surface of the interface;
- the elastic return member is formed by at least a portion of the peripheral wall of the bell housing;
- the elastic return member is distinct from the bell housing and is engaged in at least one opening in the peripheral wall of the bell housing in order to mount it on the bell housing and form said bearing member;
- the elastic return member comprises a solid disk or a disk that has a central opening;
- the elastic return member comprises elastically flexible radial fingers;
- the elastic return member comprises an annular portion; and each said elastically flexible finger extends between a free end and an end that is attached to said annular portion;
- said annular portion is arranged centrally;
- said annular portion is arranged peripherally;
- the bearing member is formed by at least one portion projecting toward the inside of the peripheral wall of the bell housing;
- the elastic return member is formed by a fluid or gel placed between the main body of the bell housing and the first transverse end surface of the elastically compressible interface;
- said bearing member is configured such that the interface is oriented the same as said main body of the bell housing;
- said bearing member is configured such that the interface is inclined with respect to said main body of the bell housing;
- said flexible pad, said elastically compressible interface and said main body have openings configured to convey a cutting fluid toward the workpiece surface;
- one said opening is arranged centrally in said flexible pad and in said elastically compressible interface;
- the main body and/or the peripheral wall of the bell housing are divided into a plurality of angular segments;
- the lateral surface and/or the first transverse surface of the interface are fixed to the peripheral wall of the bell housing by push-fitting or bonding; and/or
- the elastically compressible interface has a thickness of between 1 mm and 20 mm between the first transverse end surface and the second transverse end surface.

The invention moreover proposes a surfacing machine comprising an optical-quality surfacing tool as mentioned above.

BRIEF DESCRIPTION OF THE DRAWINGS

The description of the invention will now be continued with a detailed description of some exemplary embodiments given hereinafter by way of nonlimiting illustration with reference to the attached drawings. In these drawings.

DETAILED DESCRIPTION OF ONE EXEMPLARY EMBODIMENT

Figure 1:
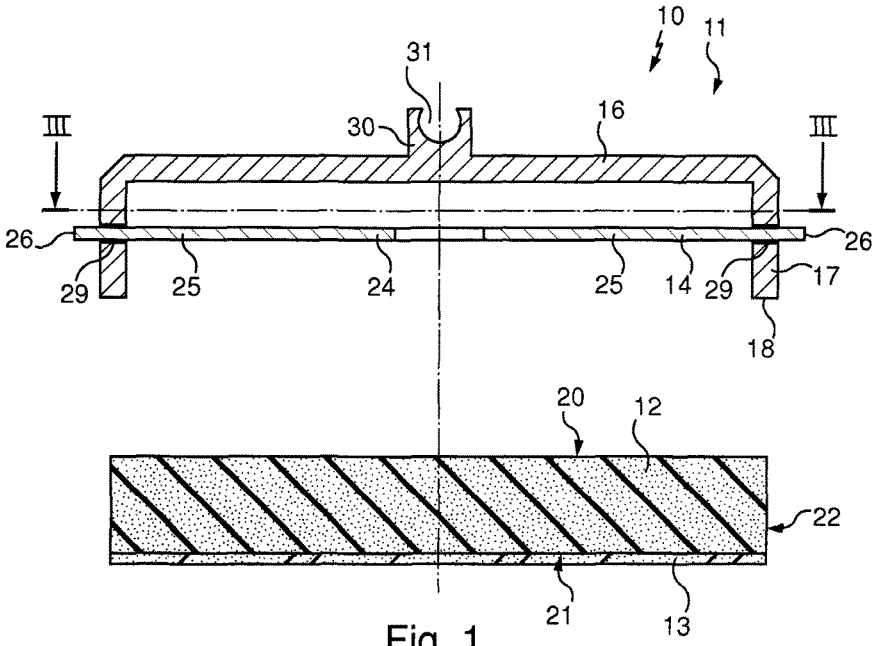
FIGS. 1 and 2 are views in elevation-section of a surfacing tool according to the invention, these respectively being an exploded view and a view in the assembled state.

The tool 10 illustrated in FIGS. 1 to 6 comprises a bell housing 11, an elastically compressible interface 12, a flexible pad 13 and an elastic return member 14.

In general, with the exception of the elastic return member 14, the tool 10 is cylindrical overall with symmetry of revolution and has an axis of symmetry illustrated in FIGS. 1, 2, 5 and 6 that defines an axial direction.

The bell housing 11 comprises a main body 16, in this instance a flange, and a peripheral wall 17 projecting from the periphery of the main body 16 as far as a free end 18.

In this instance, the main body 16 has the overall shape of a disk oriented transversely to the axial direction; and the peripheral wall 17 is an annular wall extending in the axial direction.

The interface 12 has a first end surface 20, a second end surface 21 and a lateral surface 22 extending from the periphery of the surface 20 to the periphery of the surface 21.

The surfaces 20 and 21 extend transversely to the axial direction of the interface 12 and in this instance are planar.

Under no load, the interface 12 and the pad 13 have the overall shape of a disk of the same diameter, with the thickness of the interface 12 being higher than the thickness of the pad 13.

In this instance, the interface 12 has a thickness (distance between the surfaces 20 and 21) of between 1 mm and 20 mm.

The pad 13 is pressed against and covers the surface 21 of the interface 12.

The pad 13 and interface 12 are secured to one another in this instance by bonding over the entirety of the surface 21.

Figure 3:
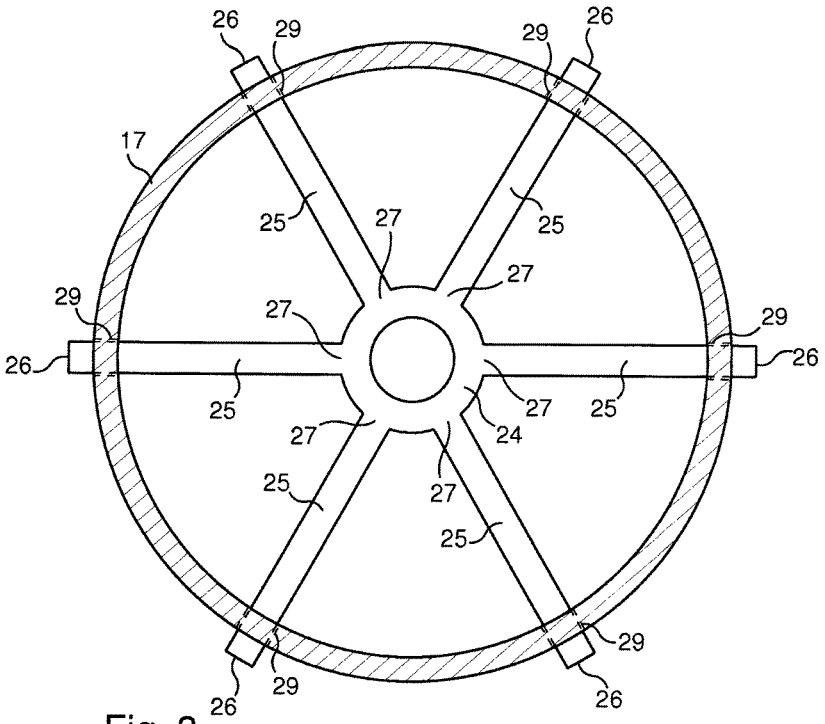
FIG. 3 is a plan view in section on of FIG. 1.

The elastic return member 12 is in this instance a star-shaped component. As can be seen in FIG. 3, the elastic return member 14 comprises an annular portion 24, in this instance arranged centrally, and elastically flexible fingers 25 which extend, in this instance, radially from the annular portion 24.

Each finger 25 extends between a free end 26 and an end 27 that is attached to the annular portion 24.

Figure 2:
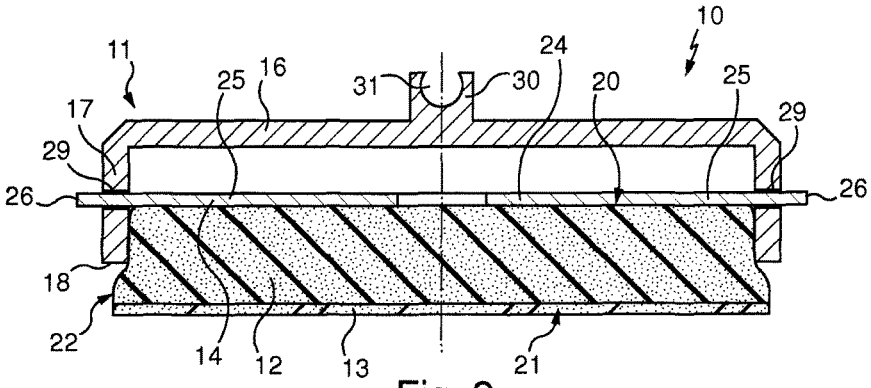

As is clearly visible in FIGS. 1 and 2, in this instance the elastic return member 14 is flat.

The length of the elastic fingers 25 is such that the elastic return member 14 has an outside diameter that is greater than the outside diameter of the peripheral wall 17 of the bell housing 11.

The peripheral wall 17 has openings 29 in each of which a distal portion of one of the flexible fingers 25 is engaged.

The elastic return member 14 and the bell housing 11 are thus assembled by engaging the flexible fingers 25 in the openings 29.

Under no load, the diameter of the interface 12 and of the pad 13 is slightly greater than the inside diameter of the peripheral wall 17 of the bell housing 11, as can be seen clearly in FIG. 1.

The assembly formed by the interface 12 and the pad 13 is fitted by a forcible push-fit of the interface 12 into the space delimited laterally by the peripheral wall 17 between its free end 18 and the elastic return member 14.

The thickness of the interface 12 is greater than the distance between the free end 18 and the openings 29 and therefore the elastic return member 14 engages in these openings.

When the interface 12 is pushed into the bell housing 12, it enters this housing until the surface 20 meets the elastic return member 14.

The annular portion of the lateral surface 22 of the interface 12 situated between the free end 18 of the peripheral wall 17 and the surface 21 is free.

The elastic return member 14 lies some distance from the main body 16. As a result, the surface 20 of the interface 12, which is against the elastic return member 14, is some distance from the main body 16.

Figure 5:
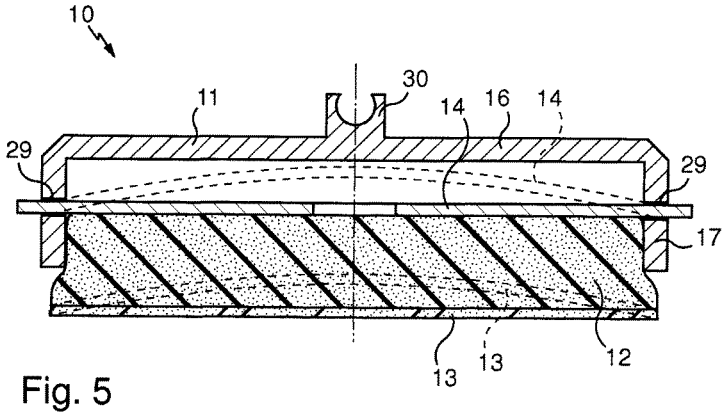
FIGS. 5 and 6 are views similar to FIG. 2 but showing in broken line examples of configurations adopted, during the surfacing operation illustrated in FIG. 4, by the elastic return member and by the flexible pad, respectively.
Figure 6:
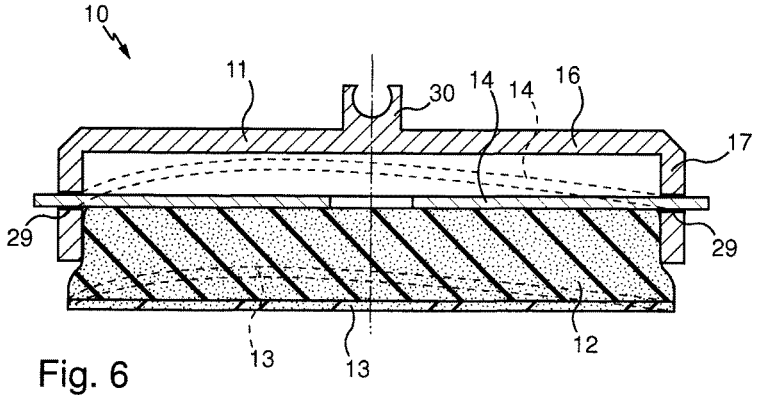

As can be seen in FIGS. 5 and 6, if a load directed toward the main body 16 is applied to the pad 13, the pad 13, the interface 12 and the elastic return member 14 may deform, with the elastic return member 14 moving closer to the main body 16.

The portion of the elastic return member 14 that is situated near the peripheral wall 17 of the bell housing 11 cannot move closer to the main body 16 because it is engaged in the openings 29.

The portion of the elastic return member 14 that is situated near the peripheral wall 17 thus forms an end stop limiting penetration between the peripheral wall 17 and the periphery of the interface 12.

In order to mount the tool 10 on a surfacing machine, a mounting member 30 is connected to the main body 16 on the opposite side to the side facing the interface 12, namely on the side that can be seen at the top in FIGS. 1, 2, 5 and 6.

Figure 4:
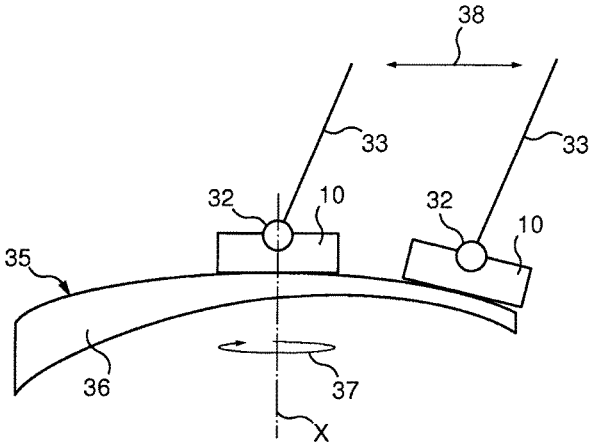
FIG. 4 is a schematic elevation view illustrating the use of the surfacing tool shown in FIGS. 1 to 3 to work on a surface of an ophthalmic lens.

The mounting member 30 in this instance is a stud formed as an integral part of the bell housing 11 and positioned centrally. Formed in this stud is a cavity 31 to accept the head 32 of a spindle 33 of a surfacing machine (FIG. 4).

The head 32 comprises an end shaped as a portion of a sphere configured like the cavity 31.

The mounting member 30 is assembled with the spindle 33 by simple clip-fastening, the material surrounding the cavity 31 being capable of deforming because the spherical part of the head 32 is being housed in the cavity 31.

When the head 32 of the spindle 33 is engaged in the cavity 31, the tool 10 collaborates with the spindle 33 in the manner of a ball-jointed connection.

As an alternative, the mounting member 30 is different than a protruding stud formed as an integral part, and is for example a mounting member attached to the main body 16 and/or that does not project with respect to the main body 16.

In order to use the tool 10 to work on the face 35 of an ophthalmic lens 36, the ophthalmic lens 36 is mounted on a rotary support (not depicted) so as to be driven in rotation about the axis X, as shown by the arrow 37.

The tool 10 is pressed against the face 35 with enough force for the pad 13 to adopt the shape thereof.

The relative friction between the face 35 and the pad 13 is enough to drive the rotation of the tool 10.

The face 35 is sprayed with a non-abrasive or abrasive cutting fluid depending on whether or not the pad 13 itself performs this function.

In order to sweep the entirety of the face 35, the tool 10 is moved in a reciprocating movement, as shown by the arrow 38.

The load applied by the spindle 33 to the tool 10 and, more specifically, to the mounting member 30, is transmitted to the pad 13 via the bell housing 11, via the bearing member formed by the portion of the elastic return member 14 situated close to the peripheral wall 17 as a result of the engagement in the openings 29, and via the interface 12.

Given that the bell housing 11 and the interface 12 bear against one another via the periphery of the interface 12, it is essentially via its periphery that the flexible pad 13 presses against the workpiece surface, in this instance the face 35 of the ophthalmic lens 36.

Surfacing is therefore performed essentially at the periphery of the pad 13.

By virtue of the ability of the tool 10 to deform, as explained hereinabove with support of FIGS. 5 and 6, the central part of the pad 13 can deform to conform as closely as possible to the workpiece surface.

More particularly, given that the interface 12 is elastically compressible and that the bell housing 11 and this interface 12 bear against one another via the periphery of the interface 12, it is possible to guarantee that the flexible pad 13 will conform well to the workpiece surface whatever this may be, in order to perform removal of material distributed as uniformly as possible and allow particularly high-quality surfacing.

Because of the ability of the tool 10 to allow the pad 13 to deform inward (toward the main body 16 and the mounting member 30), the tool 10 is particularly suited to work on convex surfaces.

As explained later on with the support of FIGS. 14 and 15, the tool 10 is generally capable of working on surfaces with different curvatures, including concave surfaces.

It will be noted that the arrangement whereby the elastic return member 14 has fingers 25 extending radially from the annular portion 24 encourages the ease with which the central portion can deform.

In the embodiment illustrated in FIG. 3, there are six radial fingers 25.

Figure 7:
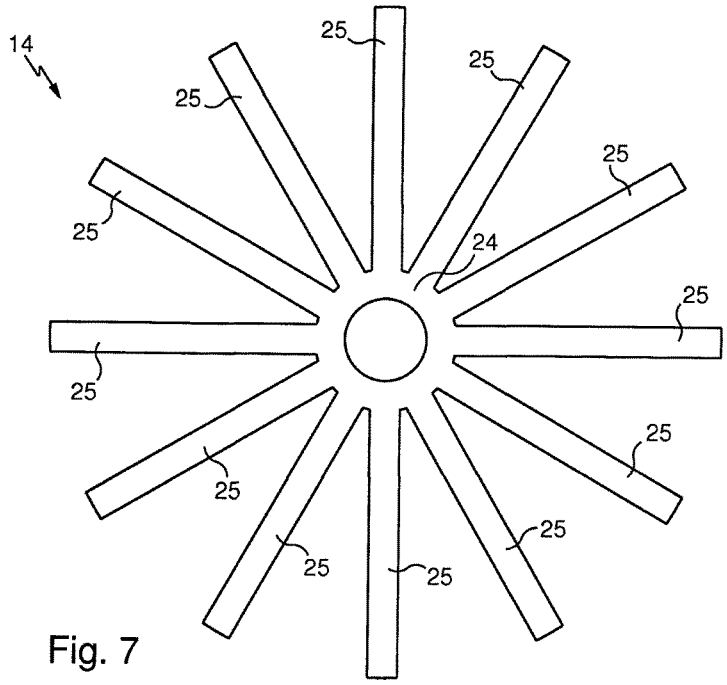
FIGS. 7 to 13 show, in the same way as FIG. 3, alternative forms of embodiment of the elastic return member.

The alternative form of embodiment of the elastic return member 14 that is illustrated in FIG. 7 is configured in the same way but with a different number of fingers 25, in this instance twelve fingers 25.

Figure 8:
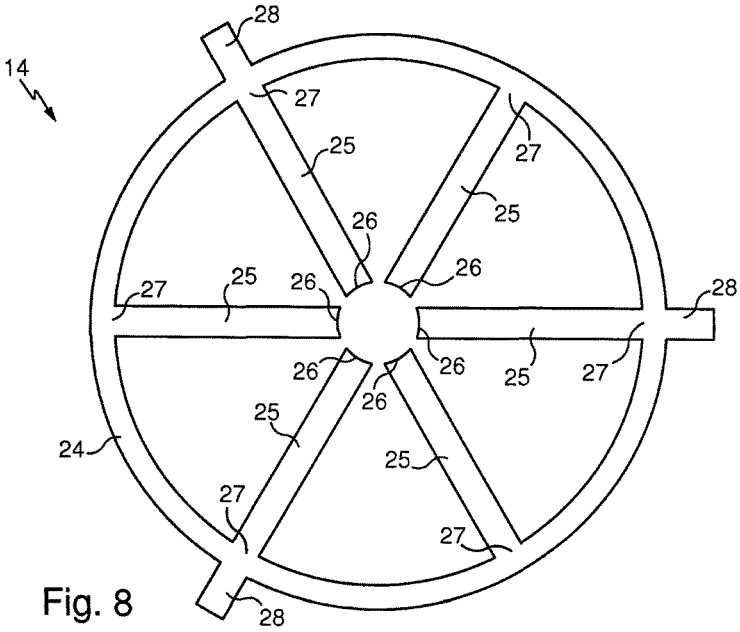

The alternative form of embodiment of the elastic return member 14 illustrated in FIG. 8 is configured in the opposite way, namely with the annular portion 24 arranged at the periphery.

The free end 26 of each finger 25 is therefore the central end and the attached end 27 is therefore the peripheral end.

The annular portion 24 has an outside diameter similar to the inside diameter of the peripheral wall 17 of the bell housing 11. Tabs 28 project externally from the annular portion 24 to be engaged in the openings 29.

Figure 9:
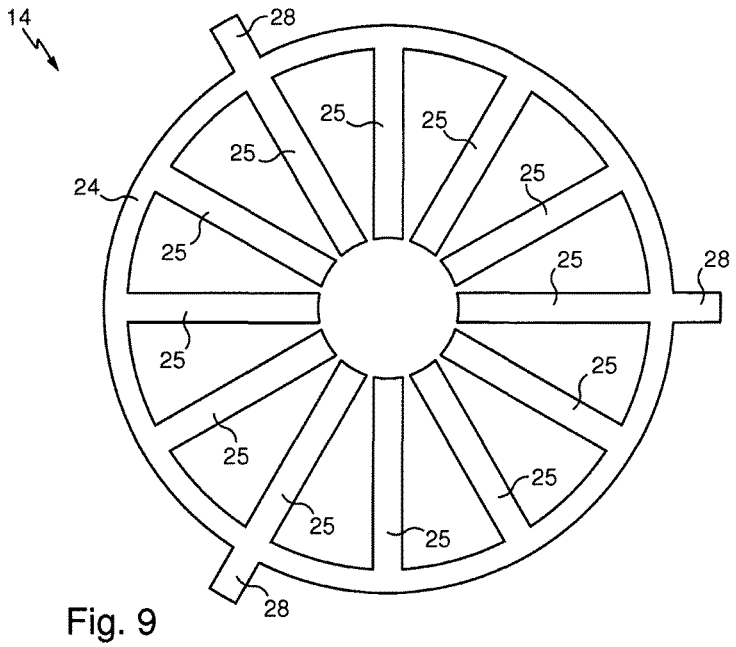

The alternative form of embodiment of the elastic return member 14 illustrated in FIG. 9 is similar to the alternative form illustrated in FIG. 8 except that there are a different number of fingers 25, in this instance twelve instead of six.

Moreover, in an alternative form of embodiment of the invention, the fingers 25 may have variable thickness, thus exhibiting different flexibility.

In one nonlimiting example, each finger may be relatively rigid at its free end and relatively flexible at the attached end.

Figure 10:
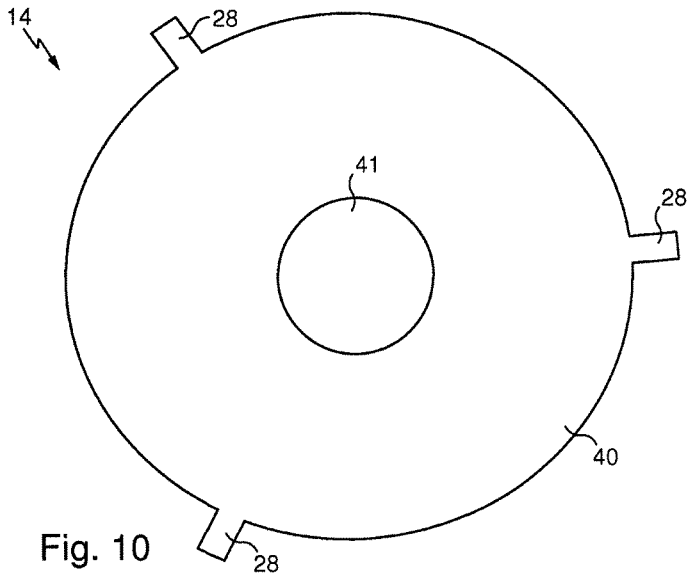

The alternative form of the embodiment of the elastic return member 14 that is illustrated in FIG. 10 is formed of a disk 40 having a central opening 41.

Figure 11:
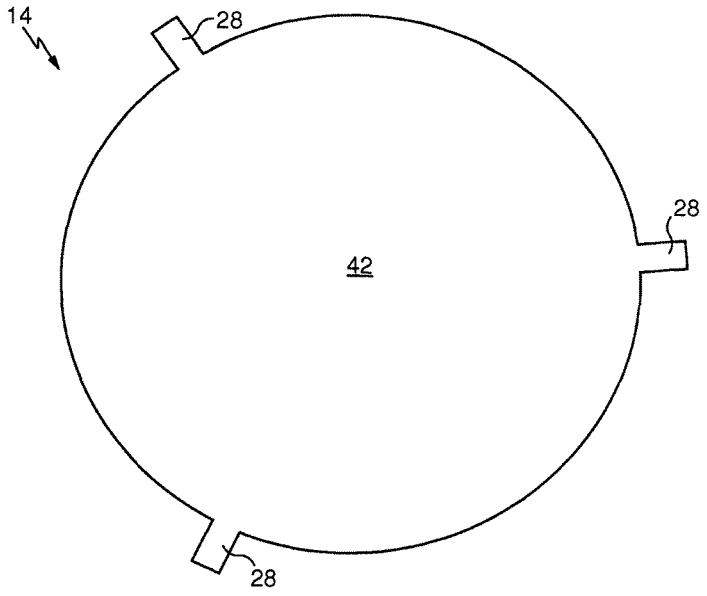

The alternative form of embodiment of the return member 14 that is illustrated in FIG. 11 is formed of a solid disk 42.

Figure 12:
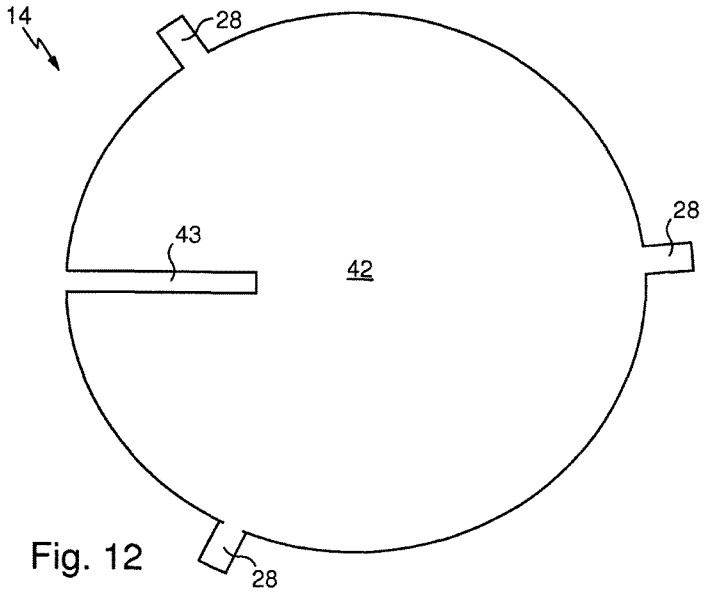

The alternative form of embodiment of the elastic return member that is illustrated in FIG. 12 is similar to the alternative form illustrated in FIG. 11 except that the solid disk 42 has a radial notch 43 extending from the periphery as far as a certain distance from the center.

Figure 13:
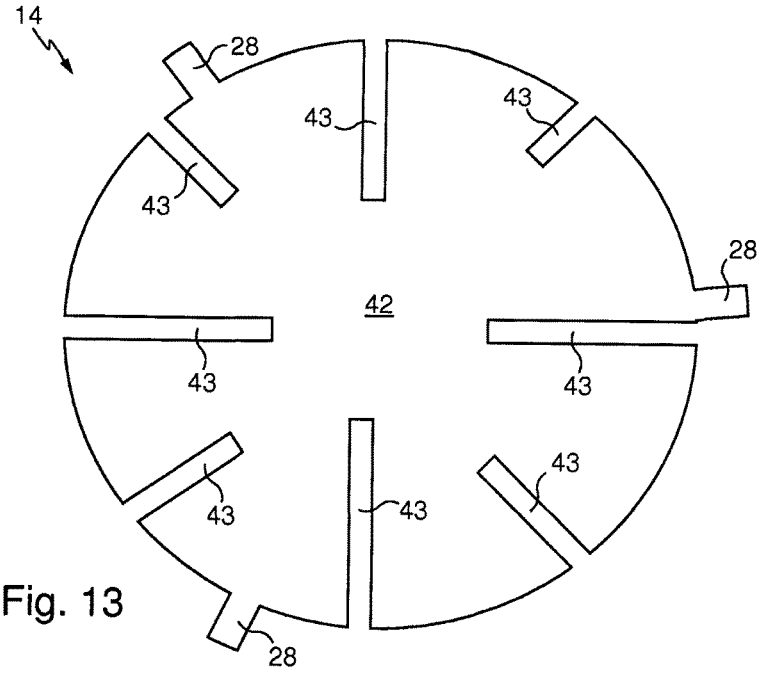

The alternative form of embodiment of the elastic return member that is illustrated in FIG. 13 is similar to the alternative form illustrated in FIG. 12 except that here there are a plurality of notches 43 of different lengths, with long notches alternating with short notches (each short notch is between two long notches).

In each of the alternative forms of embodiment of the elastic return member 14 illustrated in FIGS. 10 to 13, the disk 40 or 42 has an outside diameter corresponding to the inside diameter of the peripheral wall 17 of the bell housing 11 and the tabs 28 are used to engage the member 14 with the bell housing 11 by insertion into the openings 29.

The various examples of elastic return member 14 hitherto described are all flat.

Figure 14:
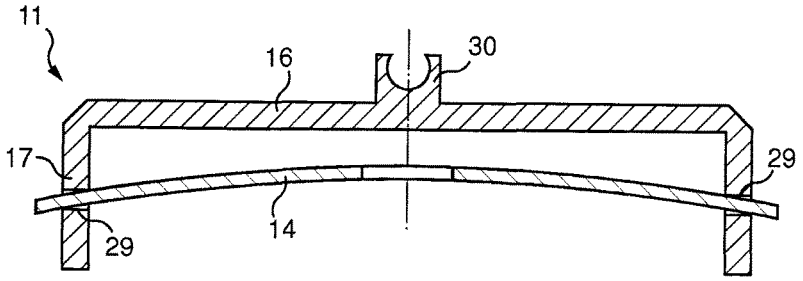
FIGS. 14 and 15 show, in the same way as FIG. 1, alternative forms of embodiment of the elastic return member in which same is domed rather than flat.
Figure 15:
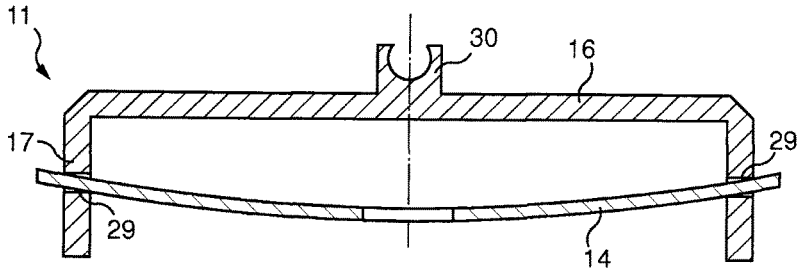

As an alternative, as shown in FIGS. 14 and 15, the elastic return member 14 is curved, with the convex face facing toward the main body 16 (FIG. 14) or the concave face facing toward the main body 16 (FIG. 15).

The embodiment illustrated in FIG. 14 is particularly suitable for working on highly convex surfaces.

The embodiment illustrated in FIG. 15 is particularly suitable for working on concave surfaces, or even on particularly concave surfaces.

Figure 16:
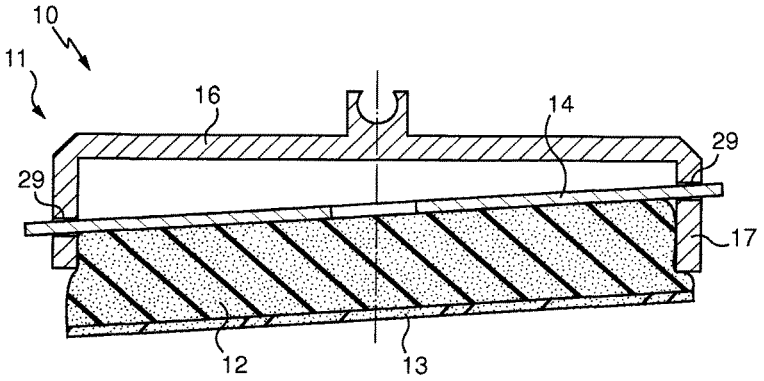
FIG. 16 is a view similar to FIG. 2 for an alternative form of embodiment in which the elastic return member, the elastically compressible interface and the flexible pad are inclined.

In each of the examples of the tool 10 described hitherto, the elastic return member 14, the elastically compressible interface 12 and the flexible pad 13 are oriented in the same way as the main body 16, namely transversely to the axial direction. In the alternative form of embodiment illustrated in FIG. 16, the elastic return member 14, the elastically compressible interface 12 and the flexible pad 13 are inclined with respect to the main body 16.

In practice, this inclination is obtained by positioning the openings 29 not at the same distance from the main body 16 but at different distances.

Figure 17:
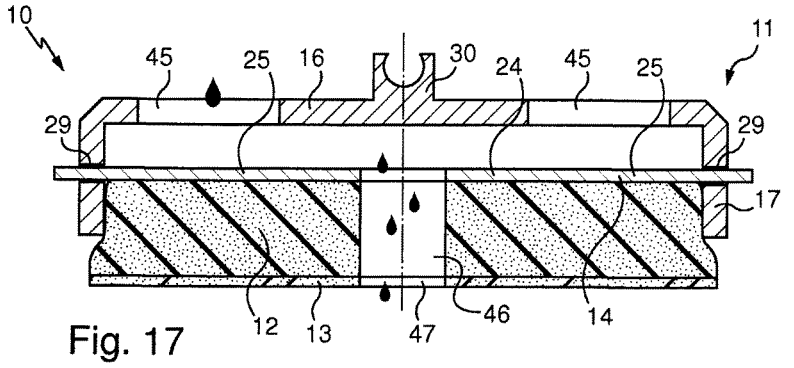
FIG. 17 is a view similar to FIG. 2 for an alternative form of embodiment in which the surfacing tool is configured to convey a cutting fluid toward the workpiece surface.

In the alternative form of embodiment illustrated in FIG. 17, the tool 10 is configured to convey the cutting fluid toward the workpiece surface, thanks to openings 45 formed in the main body 16, thanks to an opening 46 formed in the interface 12 and thanks to an opening 47 formed in the pad 13.

Figure 18:
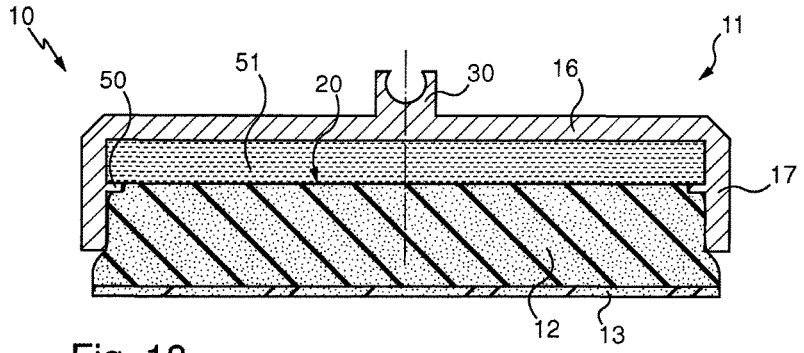
FIG. 18 is a view similar to FIG. 1 for an alternative form of embodiment in which the elastic return member is formed by a fluid or gel arranged between the bell housing and the elastically flexible interface.

In the alternative form of embodiment of the tool 10 that is illustrated in FIG. 18, the elastic return member 14 is replaced:

- on the one hand, to form the bearing member for the bearing between the peripheral wall 17 of the bell housing 11 and the periphery of the interface 12, by an internally projecting portion of the peripheral wall 17, in this instance an annular rib 50; and
- on the other hand, to form the actual elastic return member, by a fluid or a gel 51 placed between the main body 16 and the surface 20 of the interface 12.

In the example illustrated, the fluid or gel is contained in a deformable bag. The fluid is, for example, a compressed gas or a liquid.

Figure 19:
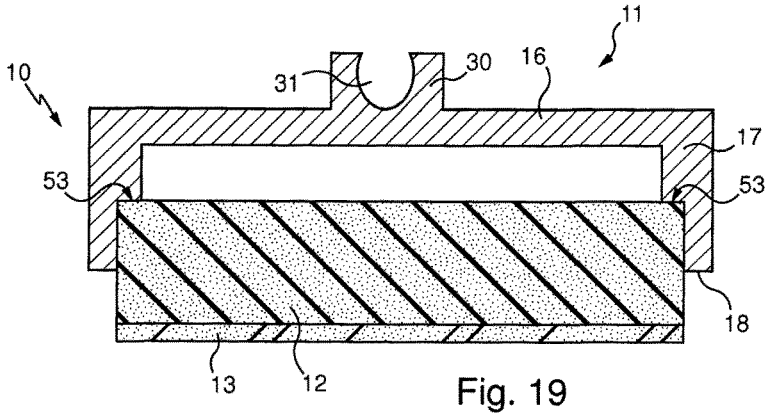
FIG. 19 is a view similar to FIG. 2 for an alternative form of embodiment in which the surfacing tool has no elastic return member.

In the alternative form of embodiment of the tool 10 that is illustrated in FIG. 19, no elastic return member is positioned between the bell housing 11 and the surface 20 of the interface 12.

This is because the elastically compressible interface 12 is in itself sufficiently elastic.

In this exemplary embodiment, the elastically compressible interface 12 is made for example from a uniform foam of chosen softness or alternatively from a foam or some other material with an elasticity gradient (greater elasticity on the side of the main body 16).

Moreover, in the alternative form of embodiment illustrated in FIG. 19, the internally projecting portion of the peripheral wall 17 for forming the bearing member delimits not a rib 50 but a shoulder 53.

Figure 20:
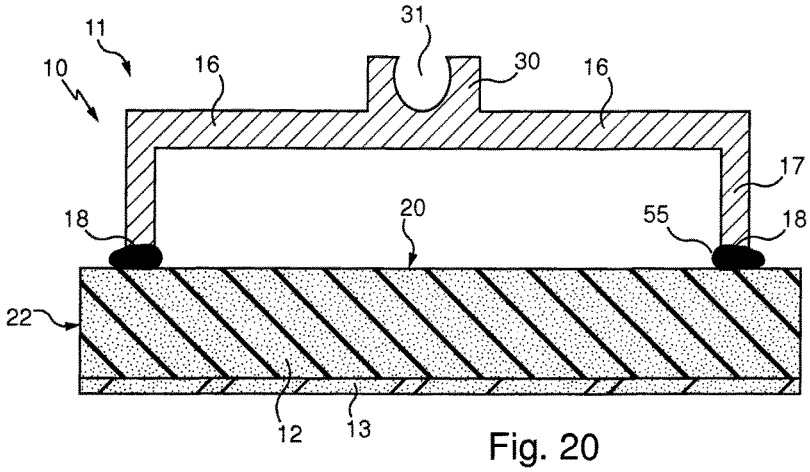
FIGS. 20 and 21 are views similar to FIG. 2 for other alternative forms of embodiment without an elastic return member in which forms the elastically flexible interface is fixed to the bell housing by bonding rather than by push-fitting, the bell housing of the alternative form of embodiment in FIG. 21 being configured differently.
Figure 21:
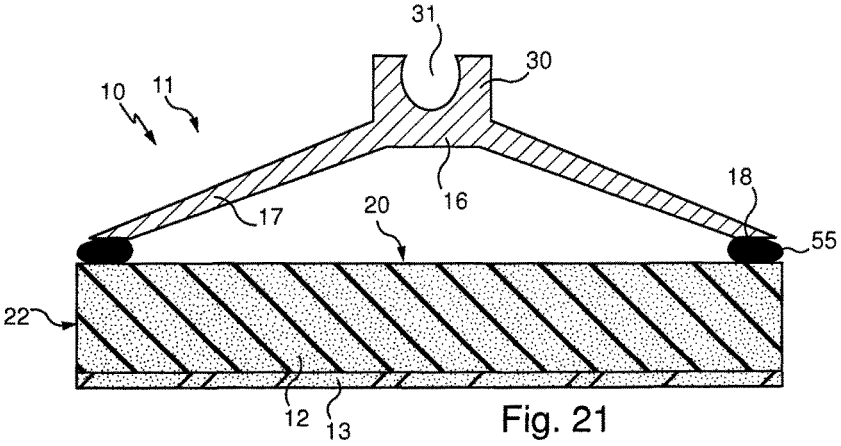
Figure 22:
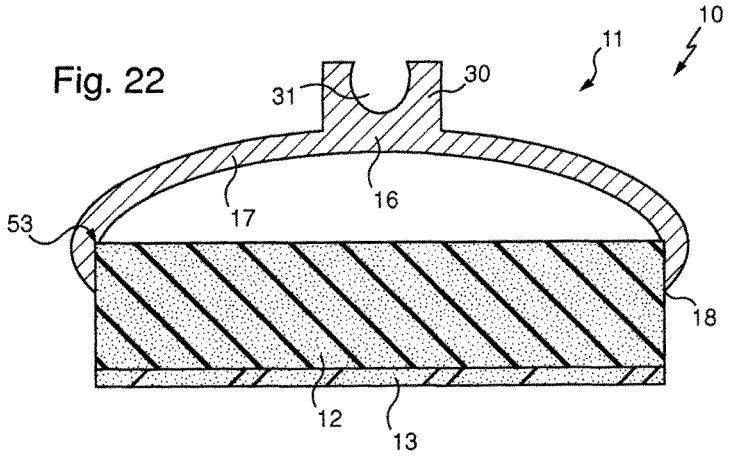
FIG. 22 is a view similar to FIG. 2 for an alternative form of embodiment similar to the alternative form of embodiment illustrated in FIG. 19, but in which it is the bell housing that is configured differently.

In the alternative forms of embodiment of the surfacing tool 10 illustrated in FIGS. 20, 21 and 22, just as in the alternative form of FIG. 19, the tool 10 has no elastic return member.

In the alternative forms of embodiment illustrated in FIGS. 20 and 21, the assembly formed by the elastically compressible interface 12 and the flexible pad 13 is not push-fitted into the bell housing 11: the peripheral wall 17 of the bell housing 11 is not pressed against part of the lateral surface 22 of the interface 12 but against part of the end surface 20 of the interface 12.

The lateral surface 22 of the interface 12 is therefore completely free.

The bearing member for the bearing between the peripheral wall 17 of the bell housing 11 and the periphery of the interface 12 is formed by the free end 18 of the peripheral wall 17.

The bell housing 11 and the interface 12 are fixed together by a bead of adhesive 55.

The alternative form of embodiment of the tool 10 illustrated in FIG. 21 is similar to the alternative form illustrated in FIG. 20 except that the bell housing 11 is configured differently: the main body 16 is present only in the center of the bell housing 11 and the peripheral wall 17 is frustoconical.

The alternative form of embodiment of the tool 10 that is illustrated in FIG. 22 is similar to the alternative form illustrated in FIG. 19 except that the bell housing is configured differently: the main body 16 is present only at the center of the bell housing 11 and the peripheral wall 17 is curved inward.

In this alternative form of embodiment, the shoulder 53 may be achieved by a glued joint.

Figure 23:
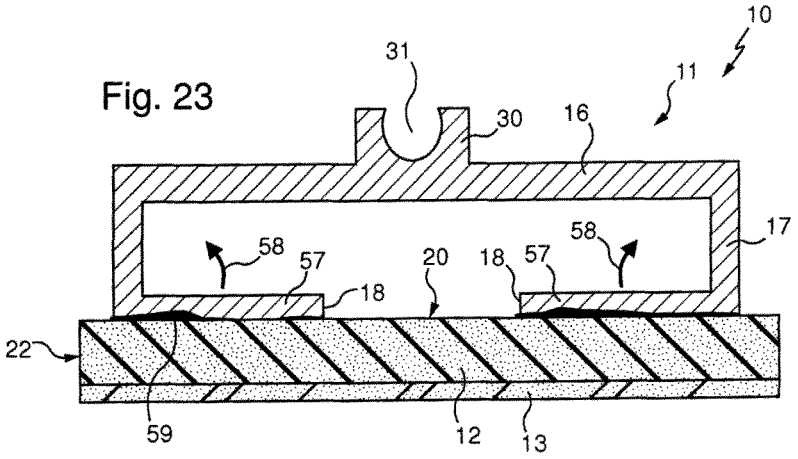
FIG. 23 is a view similar to FIG. 2 for an alternative form of embodiment of the bell housing configured differently and made from an elastic material.
Figure 25:
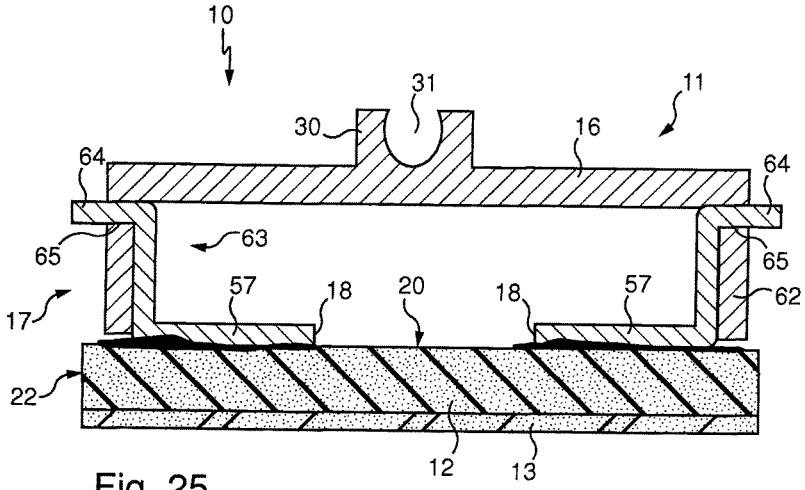
FIG. 25 is a view similar to FIG. 2 for an alternative form of embodiment similar to the alternative form of embodiment illustrated in FIG. 23, but in which the peripheral wall of the bell housing is made in two parts.

In the alternative forms of embodiment of the tool 10 that are illustrated in FIGS. 23 and 25, the elastic return member is not a member distinct from the bell housing but is formed notably by the peripheral wall 17 of the bell housing 11.

In the alternative form of embodiment illustrated in FIG. 23, the peripheral wall 17 comprises a return 57 directed toward the inside of the bell housing 11. If a force directed toward the main body 16 is applied to the return 57 then the peripheral wall 17 comprising the return 57 flexes elastically toward the main body 16, as shown in FIG. 23 by the arrows 58.

The bearing member for bearing between the peripheral wall 17 and the interface 12 is formed by the return 57.

The interface 12 and the bell housing 11 are fixed together by a film of adhesive 59 applied between the surface 20 of the interface 12 and the return 57.

Figure 24:
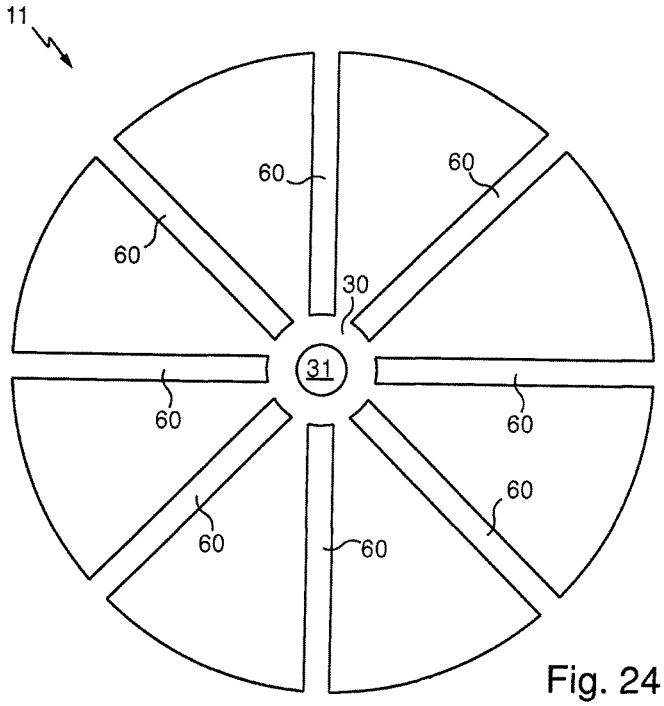
FIG. 24 is a plan view of an alternative form of embodiment of the bell housing in which the peripheral wall has radial notches to make it elastically flexible.

FIG. 24 shows a bell housing 11 in which notches 60 are made in order to allow (or to contribute to allowing) the bell housing 11 to act directly as an elastic return member. The notches 60 subdivide the main body 16 and/or the lateral wall 17 of the bell housing 11 into a plurality of angular segments.

The alternative form of embodiment illustrated in FIG. 25 is similar to the alternative form illustrated in FIG. 23 except that the peripheral wall 17 is formed by an annular wall 62 formed as an integral part of the main body 16 and by an insert 63 firmly secured to the annular wall 62, in this instance by tabs 64 each engaged in an opening 65 in the wall 62.

In alternative forms of embodiment that have not been illustrated, the fixing-together of the interface 12 and of the bell housing 11 is performed in some way other than by push-fitting or bonding, for example using clips, studs or a bayonet fitting.

Numerous other alternative forms of embodiment are possible according to circumstances and it must be recalled in this regard that the invention is not restricted to the examples described and depicted.

The invention claimed is:

1. An optical-quality surfacing tool comprising:

an elastically compressible interface (12) comprising a first transverse end surface (20), a second transverse end surface (21) and a lateral surface (22) extending from the periphery of the first transverse end surface (20) to the periphery of the second transverse end surface (21);

a flexible pad (13) configured to be pressed against a workpiece surface (35), and secured to the interface (12) by its second transverse end surface (21); and a connecting structure connecting said elastically compressible interface (12) and a member (30) for mounting the tool (10) on a surfacing machine (32, 33);

wherein said connecting structure is configured to form a bearing surface resting against part of the lateral surface (22) and/or of the first transverse end surface (20) of the interface (12), leaving at least part of the lateral surface (22) and at least a central part of the first transverse end surface (20) of the interface (12) free.

2. The tool as claimed in claim 1, wherein said connecting structure comprises a bell housing (11) comprising a main body (16) and a peripheral wall (17) projecting from the periphery of said body (16) and extending as far as a free end (18); and said connecting structure comprises a bearing member (14; 50; 53; 18; 57) between the peripheral wall (17) of the bell housing (11) and the periphery of the interface (12); said peripheral wall (17) of the bell housing (11) being pressed against a part of the lateral surface (22) and/or of the first transverse surface (20) of the interface (12); at least an annular portion of the lateral surface (22) of the interface (12) being free; said first transverse end surface (20) of the interface (12) being on the side of and distant from the main body (16).

3. The tool as claimed in claim 2, further comprising an elastic return member positioned between the bell housing (11) and the first transverse end surface (20) of the interface (12).

4. The tool as claimed in claim 3, wherein the elastic return member is formed by at least a portion (57) of the peripheral wall (17) of the bell housing (11).

5. The tool as claimed in claim 3, wherein the elastic return member (14) is distinct from the bell housing (11) and is engaged in at least one opening (29) in the peripheral wall (17) of the bell housing (11) in order to mount it on the bell housing (11) and form said bearing member.

6. The tool as claimed in claim 3, wherein the elastic return member (14) comprises a solid disk (42) or a disk (40) that has a central opening (41).

7. The tool as claimed in claim 3, wherein the elastic return member (14) comprises elastically flexible radial fingers (25).

8. The tool as claimed in claim 7, wherein the elastic return member (14) comprises an annular portion (24); and each said elastically flexible finger (25) extends between a free end (26) and an end (27) that is attached to said annular portion (24).

9. The tool as claimed in claim 2, wherein the bearing member is formed by at least one portion (50; 53; 57) projecting toward the inside of the peripheral wall (17) of the bell housing (11).

10. The tool as claimed in claim 3, wherein the elastic return member is formed by a fluid or gel (51) placed between the main body (16) of the bell housing (11) and the first transverse end surface (20) of the elastically compressible interface (12).

11. The tool as claimed in claim 2, wherein said bearing member (14; 50; 53; 18; 57) is configured such that the interface (12) is oriented the same as said main body (16) of the bell housing (11).

12. The tool as claimed in claim 2, wherein said flexible pad (13), said elastically compressible interface (12) and said main body (16) have openings (45, 46, 47) configured to convey a cutting fluid toward the workpiece surface (35).

13. The tool as claimed in claim 2, wherein the main body (16) and/or the peripheral wall (17) of the bell housing (11) are divided into a plurality of angular segments.

14. The tool as claimed in claim 2, wherein the lateral surface (22) and/or the first transverse end surface (20) of the interface (12) are fixed to the peripheral wall (17) of the bell housing (11) by push-fitting or bonding.

15. The tool as claimed in claim 2, wherein the elastically compressible interface (12) has a thickness of between 1 mm and 20 mm between the first transverse end surface (20) and the second transverse end surface (21).

16. A surfacing machine comprising an optical-quality surfacing tool as claimed in claim 1.

17. The tool as claimed in claim 5, wherein the elastic return member (14) comprises a solid disk (42) or a disk (40) that has a central opening (41).

18. The tool as claimed in claim 4, wherein the elastic return member (14) comprises elastically flexible radial fingers (25).

19. The tool as claimed in claim 5, wherein the elastic return member (14) comprises elastically flexible radial fingers (25).

* * * * *